United States Patent [19]

Sung et al.

[11] 4,256,595

[45] Mar. 17, 1981

[54] DIESEL LUBRICANT COMPOSITION CONTAINING 5-AMINO-TRIAZOLE-SUCCINIC ANHYDRIDE REACTION PRODUCT

[75] Inventors: Rodney L. Sung, Fishkill; Benjamin H. Zoleski, Beacon, both of N.Y.

[73] Assignee: Texaco Inc., White Plains, N.Y.

[21] Appl. No.: 91,607

[22] Filed: Nov. 5, 1979

Related U.S. Application Data

[63] Continuation-in-part of Ser. No. 946,694, Sep. 28, 1978, abandoned.

[51] Int. Cl.[3] ..... C10M 1/32

[52] U.S. Cl. ..... 252/51.5 A; 252/392; 252/403

[58] Field of Search ..... 252/51.5 A, 392, 403

[56] References Cited

U.S. PATENT DOCUMENTS

| | | | |
|---|---|---|---|
| 3,219,666 | 11/1965 | Norman et al. | 252/51.5 A X |
| 3,272,746 | 9/1966 | LeSuer et al. | 252/51.5 A X |
| 3,341,542 | 9/1967 | LeSuer et al. | 252/51.5 A X |
| 3,785,981 | 1/1974 | Hotten | 252/51.5 A |
| 3,969,237 | 7/1976 | Andress, Jr. | 252/51.5 A X |
| 4,048,082 | 9/1977 | Nnadi et al. | 252/51.5 A |
| 4,053,426 | 10/1977 | Davis et al. | 252/51.5 A X |

FOREIGN PATENT DOCUMENTS

| | | | |
|---|---|---|---|
| 621469 | 8/1962 | Belgium | 252/51.5 A |

*Primary Examiner*—Andrew Metz

*Attorney, Agent, or Firm*—Carl G. Ries; Robert A. Kulason; James J. O'Loughlin

[57] ABSTRACT

A diesel crankcase lubricant composition comprising a lubricating oil base and the reaction product of a hydrocarbyl succinic anhydride in which the hydrocarbyl radical has from 12 to 30 carbon atoms and 5-aminotriazole is provided.

9 Claims, No Drawings

DIESEL LUBRICANT COMPOSITION CONTAINING 5-AMINO-TRIAZOLE-SUCCINIC ANHYDRIDE REACTION PRODUCT

CROSS-REFERENCE TO RELATED APPLICATION

This application is a continuation-in-part of application Ser. No. 946,694, filed on Sept. 28, 1978 and now abandoned.

This application is related to application Ser. No. 753,962, filed Dec. 23, 1976, entitled RUST INHIBITOR AND OIL COMPOSITION CONTAINING SAME, copending herewith, which is directed to motor fuel compositions comprising a mixture of hydrocarbons in the gasoline boiling range and a rust inhibitor which is the reaction product of a hydrocarbyl succinic anhydride and any one of a number of aminotriazoles.

BACKGROUND OF THE INVENTION

1. Field of the Invention

This invention relates to a diesel crankcase lubricant composition. More especially, this invention relates to an anti-oxidant and corrosion inhibitor for diesel crankcase lubricant composition. More especially, this invention relates to a diesel crankcase lubricant composition which satisfies the onerous criteria of the Union Pacific Oxidation Test (UPOT) for oxidative stability and corrosion resistance.

2. Discussion of the Prior Art

Numerous diesel crankcase lubricant compositions are known. It is also known to include in such compositions anti-oxidants or corrosion inhibitors. For instance, it is known to employ a thiodiazole as a corrosion inhibitor for a diesel crankcase lubricating oil.

Unfortunately, the diesel crankcase lubricating oil compositions heretofore provided have not satisfied the criteria of the Union Pacific Oxidation Test in respect of oxidation stability and corrosion control. Such test is run by heating 300 cc of test oil to 285° F. for 144 hours. The test oil contains a copper-lead steel backed test specimen and oxygen is passed through the oil at a rate of 5 liters per hour. The test requires that the weight loss of the test strip not exceed 50 mg and that the viscosity increase of the test oil be not greater than 20 percent. The weight loss of the test strip is a measure of the extent to which corrosion inhibition has been effected. The extent to which the viscosity increases is a measure of the oxidation resistance of the crankcase lubricant. Heretofore no known diesel crankcase lubricant composition has satisfied both of the criteria of the UPOT test.

It is an object of this invention, therefore, to provide a diesel crankcase lubricant composition which satisfies the onerous criteria of the Union Pacific Oxidation Test, both in respect of oxidative stability and corrosion resistance. It is a further object of this invention, therefore, to provide an anti-oxidant and corrosion inhibitor for diesel crankcase lubricant oil. It is still a further object of this invention to provide a corrosion inhibitor and/or anti-oxidant for a diesel engine oil containing composition which can be relatively inexpensively synthesized and which is readily soluble in the diesel crankcase lubricant oil.

SUMMARY OF THE INVENTION

In accordance with the foregoing, the objects of the invention are provided by a diesel lubricating oil composition comprising a diesel lubricating oil and the reaction product of a hydrocarbyl succinic anhydride in which the hydrocarbyl radical has from about 12 to about 30 carbon atoms and 5-aminotriazole.

The diesel lubricating oil composition of the present invention contains the reaction product in an amount of between 0.25 and 2.0 weight percent, preferably between 0.5 and 1.5 weight percent, especially 0.75 to 1.5 weight percent and more especially at least 1 percent by weight.

It has been surprisingly found that the reaction product of a hydrocarbyl succinic anhydride in which the hydrocarbyl radical has from about 12 to about 30 carbon atoms and, specifically, 5-aminotriazole functions as an exceptionally effective anti-oxidant and corrosion inhibitor for diesel lubricating oil compositions, especially when the product is present in the composition in an amount of at least 1.0 weight percent. This is especially surprising considering that a position isomer thereof, namely, the reaction product of a hydrocarbyl succinic ahydride in which the hydrocarbyl radical has 12 to 30 carbon atoms and 4-aminotriazole does not function as a corrosion inhibitor for a diesel lubricant. For instance, whereas the hydrocarbyl succinic anhydride - 5-aminotriazole composition at the 1.0 weight percent level inhibits corrosion to the extent that the weight loss of the strips is only 35.1 mg, the hydrocarbyl succinic anhydride - 4-aminotriazole reaction product permits the removal of material from the test strip in an amount of 225 mg or approximately 175 mg beyond that which can be tolerated in accordance with the standards of UPOT. The 3-aminotriazole compound is also not effective as a corrosion inhibitor.

The preparation of the reaction product used in a diesel lubricating composition according to the invention is relatively uncomplicated and can be economically conducted. The hydrocarbon-substituted succinic anhydride and the 5-aminotriazole are reacted in the proportion of about 0.75 to 1.25 mols of 5-aminotriazole per mol of hydrocarbon-substituted succinic anhydride. It is preferred, however, to prepare the reaction product by reacting approximately equimolar amounts of the hydrocarbon-substituted succinic anhydride and the 5-aminotriazole. Corrosion inhibitors and anti-oxidants result when the reactants are reacted within the broad ranges set forth herein. Especially effective corrosion inhibitors and anti-oxidants are obtained when essentially equimolar proportions of the reactants are employed.

The reaction is facilitated by the use of a solvent for the reactants which is inert to the reactants and to the reaction product. A broad range of inert organic, aromatic and aliphatic solvents are suitable for this purpose including benzene, toluene, pentane, hexane and heptane.

The reaction is broadly conducted at a temperature in the range of room temperature to about 150° C., preferably 50° to 100° C. In practice, it is convenient to conduct the reaction at the reflux temperature of the solvent employed for the reaction.

Suitable hydrocarbyl-substituted succinic acid reactants are those represented by the formula

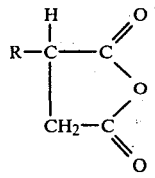

wherein R is a monovalent aliphatic hydrocarbon radical having from about 12 to 30 carbon atoms. The hydrocarbon radical can be straight or branch chained and it can be saturated or unsaturated. Particularly preferred reactants are the alkenylsuccinic anhydrides in which the alkenyl radical has from about 12 to 24 carbon atoms, preferably 12 to 14 carbon atoms. Examples of suitable hydrocarbon substituted succinic anhydrides include dipropenylsuccinic anhydride, tripropenylsuccinic anhydride, dodecenylsuccinic anhydride, tetrapropenylsuccinic anhydride, pentapropenylsuccinic anhydride and hexadecenylsuccinic anhydride.

As a result of the process, there is obtained a reaction product which is effective both as an anti-oxidant and as a corrosion inhibitor for diesel lubricating compositions containing diesel lubricating oils. The reaction product is believed to have the formulae

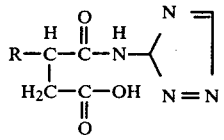

or

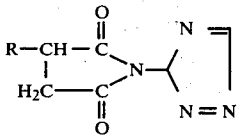

depending upon whether the hydroxyl group of the succinic acid formed during the reaction reacts in turn with the hydrogen atoms of the amine group of the aminotriazole.

In the preparation of the anti-oxidant/corrosion inhibitor, the 5-aminotriazole is reacted with the hydrocarbyl substituted succinic acid broadly at a temperature ranging from room temperature to about 150° C. until a substantial completion of the reaction. The reaction is conducted in the absence of any catalyst, but generally in the presence of a solvent or diluent to facilitate the reaction. The solvent or diluent is one compatible with the components of the diesel crankcase lubricating oil.

Of the 5-aminotriazoles used, we prefer 5-aminotriazole (1,3,4).

In order to more fully illustrate the nature of the invention and the manner of practicing the same, the following examples are presented.

EXAMPLE I

2/10 of 1 mol of polyisobutenylsuccinic anhydride of molecular weight of about 335 was allowed to react with 0.25 mol of 5-aminotriazole in 30 ml benzene. The reaction mixture was refluxed for 36 hours, filtered and stripped.

In a similar manner, 2/10 of 1 mol of tetrapropenylsuccinic acid anhydride of molecular weight 168 is allowed to react with 0.26 mol 5-aminotriazole in 300 benzene. Similarly, the reaction mixture is refluxed for 36 hours, is filtered and is stripped.

EXAMPLE II

In order to determine the ability of the hydrocarbylsuccinic acid anhydride - 5-aminotriazole reaction product to effectively reduce corrosion in a diesel lubricating oil composition and lessen oxidation therein, several diesel oil lubricating compositions were formulated and subjected to the Union Pacific Oxidation Test. The composition of the oils and the Union Pacific Oxidation Test values are set forth in Table I below.

From the data above, it is seen that the polyisobutenyl 5-aminotriazole succinimide is an effective antioxidant for diesel lubricating oil compositions. Furthermore, the polyisobutenyl 5-aminotriazole is effective especially at the 1.0 weight percent level as a corrosion inhibitor. Thus, a diesel lubricating oil composition containing at least 1.0 weight percent polyisobutenyl 5-aminotriazole satisfies both of the onerous requirements of the Union Pacific Oxidation Test.

The polyisobutenyl 5-aminotriazole is also far more effective than the position thereof, the polyisobutenyl 4-aminotriazole. The data shows, in fact, that the polyisobutenyl 5-aminotriazole succinimide is more effective at the 1.0 percent level than the polyisobutenyl 4-aminotriazole succinimide at the 2 percent level. This is quite surprising and unexpected.

TABLE I

| Composition, weight percent | A | B | C | D | E | F | G | Test Limits |
|---|---|---|---|---|---|---|---|---|
| Naphthenic mineral oil of viscosity 300 at 100° F. | 3.00 | 3.00 | 99.5 | 99.0 | 3.00 | 99.0 | 98.0 | |
| Paraffin mineral oil | 56.80 | 56.75 | weight | weight | 56.80 | weight | weight | |
| Naphthenic mineral oil of 75–80 viscosity at 210° F. | 31.00 | 31.00 | percent | percent | 31.00 | percent | percent | |
| Phosphosulfurized polyisobutylene dispersant | 3.20 | 3.20 | oil | oil | 3.20 | oil | oil | |
| Calcium sulfurized alkyl phenolate detergent | 6.00 | 6.00 | of | of | 6.00 | of | of | |
| Thiodiazole corrosion inhibitor | | 0.05 | Example | Example | | Example | Example | |
| Silicone foam inhibitor, ppm | 150 | 150 | A | A | 150 | A | A | |
| Polyisobutenyl (335) 5-aminotriazole succinimide | | | 0.5 | 1.0 | | | | |
| Polyisobutenyl (335) 4-aminotriazole succinimide | | | | | | 1.0 | 2.0 | |
| UPOT | | | | | | | | |
| Weight loss, mgs. | 354 | 9.4 | 702 | 35.1 | 389 | 225 | 498 | 50 mgs max. |

TABLE I-continued

| Composition, weight percent | A | B | C | D | E | F | G | Test Limits |
|---|---|---|---|---|---|---|---|---|
| Viscosity increase, % | 22 | 36 | 2.6 | 1.7 | 24 | 13 | 46 | 20% max. |

What is claimed is:

1. A diesel crankcase lubricant composition comprising a diesel lubricating oil and from about 0.25 to 2.0 weight percent of the reaction product of a hydrocarbyl succinic anhydride in which the hydrocarbyl radical has from about 12 to 30 carbon atoms and 5-aminotriazole, said reaction product being prepared by reacting from 0.75 to 1.25 moles of said 5-aminotriazole with a mole of said hydrocarbyl succinic anhydride at a temperature ranging from room temperature to about 150° C.

2. A composition according to claim 1 wherein the hydrocarbyl succinic anhydride has the formula

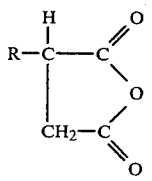

wherein R is a monovalent aliphatic hydrocarbon radical having from about 12 to 30 carbon atoms.

3. A composition according to claim 1 wherein the reaction product has the formula

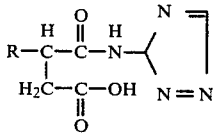

or

-continued

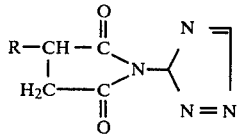

4. A composition according to claim 3 wherein the reaction product is a mixture of compounds having the formulae set forth in claim 3.

5. A composition according to claim 1 wherein said reaction product is present in an amount of between 0.5 and 1.5 weight percent.

6. A composition according to claim 5 wherein there is at least 0.75 percent by weight of said reaction product.

7. A composition according to claim 6 wherein said reaction product is present in an amount of at least 1 percent by weight.

8. A composition according to claim 1 wherein said reaction product comprises a product of the formula

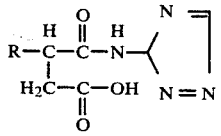

or

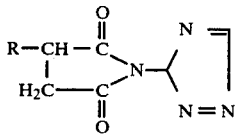

or a mixture thereof and said reaction product is present in an amount of 0.25 to 2.0 weight percent.

9. A composition according to claim 8 wherein said compound is present in an amount of at least 1 percent by weight.

* * * * *